US007158745B2

(12) United States Patent
Leemhuis et al.

(10) Patent No.: US 7,158,745 B2
(45) Date of Patent: Jan. 2, 2007

(54) METHOD AND DEVICE TO REGULATE TONER IN AN IMAGE FORMING DEVICE

(75) Inventors: Michael Craig Leemhuis, Nicholasville, KY (US); Ronald Willard Baker, Versailles, KY (US); Marc Cousoulis, Versailles, KY (US); Hrishikesh Pramod Gogate, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/086,941

(22) Filed: Mar. 22, 2005

(65) Prior Publication Data

US 2006/0216072 A1 Sep. 28, 2006

(51) Int. Cl.
*G03G 15/08* (2006.01)

(52) U.S. Cl. ..... 399/284; 399/274; 399/264

(58) Field of Classification Search ..... 399/284
See application file for complete search history.

(56) References Cited

U.S. PATENT DOCUMENTS 4,575,220 A 3/1986 Sakamoto et al.
4,796,561 A 1/1989 Takano et al.
5,210,575 A 5/1993 Kikuchi
5,338,895 A 8/1994 Ikegawa et al.
5,485,254 A 1/1996 Bogoshian et al.
5,489,974 A 2/1996 Kamaji et al.
5,552,867 A 9/1996 Sekino et al.
5,587,551 A 12/1996 Ikegawa et al.
5,729,806 A 3/1998 Niwano et al.
5,895,151 A 4/1999 Kinoshita et al.
5,920,754 A * 7/1999 Chung et al. ..... 399/119
5,978,636 A 11/1999 Yamamoto et al.
6,438,347 B1 8/2002 Nittani et al.
2005/0111888 A1 * 5/2005 Kim ..... 399/284

* cited by examiner

*Primary Examiner*—David M. Gray
*Assistant Examiner*—Joseph S. Wong
(74) *Attorney, Agent, or Firm*—Coats & Bennett

(57) ABSTRACT

A device to regulate toner within an image forming apparatus. The regulating member has a first section and a toner regulating edge with at least one gap. The regulating member controls the amount of toner that is distributed on the surface of the toner developer roller by contacting the toner developing roller in a contact region. The gap, having at least one upper edge, may regulate toner on the toner developer roller near the contact region. The toner regulating device may prevent inadvertent toner marks that may appear on printed media.

20 Claims, 3 Drawing Sheets

METHOD AND DEVICE TO REGULATE TONER IN AN IMAGE FORMING DEVICE

BACKGROUND

Image forming devices including printers, copiers, scanners, fax machines and other similar devices have become staples for business and home offices. Consumers have a wide variety of options to choose from when considering such purchases. Among the considerations for these consumers are cost, size and print quality. The ever-increasing demands of consumers continually fuel innovation in this technology.

Print quality in image forming apparatuses has improved through use of innovations in toner, toner distribution devices and image formation. Because of these improvements, both home and business offices are able to produce professional, high quality media. Inherent with the high quality images is the prevention of inadvertent toner marks that may appear on the printed media. One common mark is a band that extends along the edge of the printed image.

Image forming apparatus size and shape is a consideration for home and business offices because of space limitations and ease of use. Engineering these devices to be both easy to use and adaptable to space considerations has contributed to their popularity.

Consumers of image forming apparatuses often consider cost when selecting these devices. Therefore, it is desirable for continued technological innovation in all areas, including print quality and device dimensions, to be as cost-effective as possible.

SUMMARY

The present invention is directed to embodiments of a device for regulating toner within an image forming apparatus. One embodiment of the regulating member has a first section and a toner regulating edge. The toner regulating edge regulates the amount of toner distributed to a developer roller during image formation. At least one gap is positioned within the toner regulating edge to prevent inadvertent toner marks on printed media.

The invention is also directed to methods of regulating toner within an image forming apparatus. One embodiment of the method uses a toner regulating member with at least one gap in its toner regulating edge to control toner distribution on the toner developer roller, thereby preventing inadvertent toner marks on printed media.

DETAILED DESCRIPTION

Figure 1:
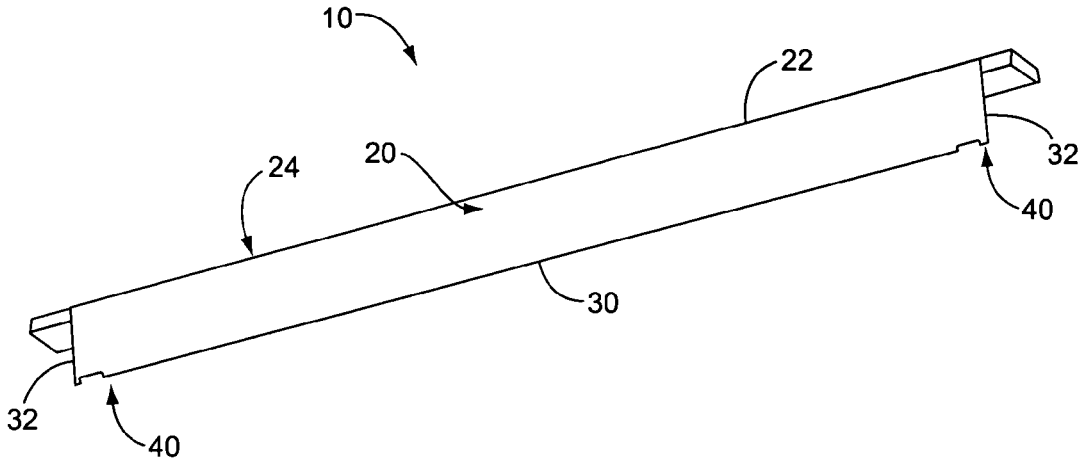
FIG. 1 is a perspective view illustrating a toner regulating member according to one embodiment of the present invention.

Embodiments of the present invention are directed to a device 10 for regulating toner within an image forming apparatus. FIG. 1 illustrates an embodiment of the regulating member 10 having a first section 20 and a toner regulating edge 30. The toner regulating edge 30 regulates the amount of toner distributed to a developer roller 50 (FIG. 2) during image formation. At least one gap 40 is positioned within the regulating edge 30.

The first section 20 may be mounted to position the regulating member 10 relative to the developer roller 50. In one embodiment as illustrated in FIG. 1, the first section 20 is connected to a bracket 24. The method of mounting the first section 20 may include clamps, screws, welding, adhesives, and various other techniques. The first section 20 may be mounted along a first edge 22 that is opposite from the toner regulating edge 30, along one or both lateral edges 32, an interior of the first section 20, or a combination thereof.

Figure 2:
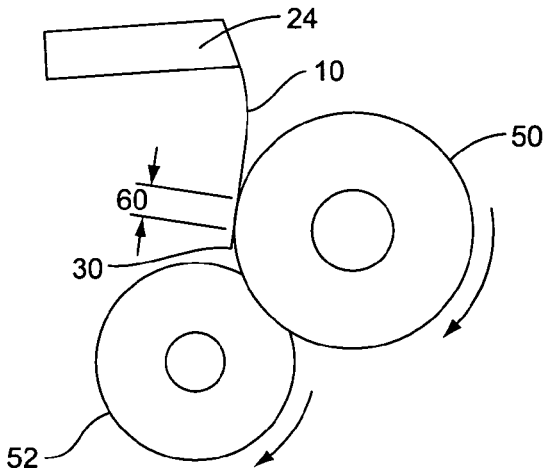
FIG. 2 is a side schematic view of the toner regulating member and its positional relationship with the toner developing roller and toner adder roller according to one embodiment of the present invention.

The toner regulating device 10 is positioned relative to a toner adder roller 52 and a toner developer roller 50 as illustrated in FIG. 2. The toner regulating member 10 is positioned to contact and regulate an amount of toner on the developer roller 50. In one embodiment, the force applied by the toner regulating device 10 to the toner developing roller 50 is about 11 Newtons. In other embodiments the amount of force applied can be about 3 to about 15 Newtons. As illustrated in the embodiment of FIG. 2, the developer roller 50 rotates into the regulating edge section of the regulating member 10 (i.e., clockwise as illustrated in the embodiment of FIG. 2). The toner adder roller 52 that contacts the developer roller 50 may also rotate in this same direction.

Figure 3:
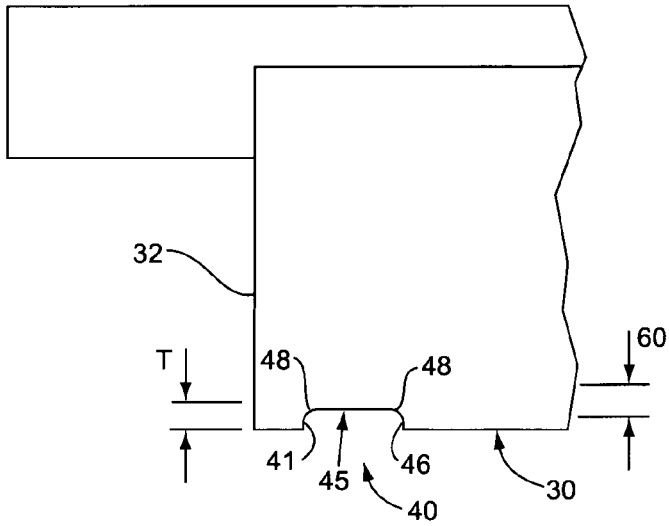
FIG. 3 is a partial side schematic view of a toner regulating member according to one embodiment of the present invention.
Figure 4:
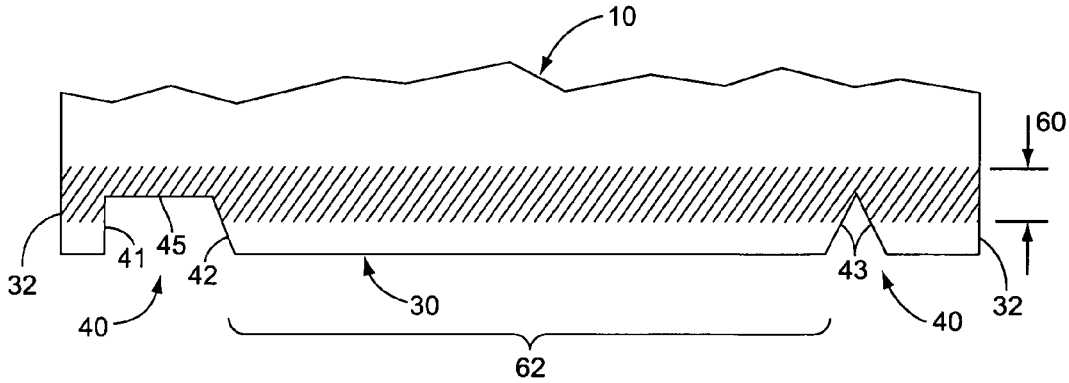
FIG. 4 is a side schematic view of two gaps in the toner regulating member according to one embodiment of the present invention.

As illustrated in FIGS. 3 and 4, the toner regulating member 10 is positioned for an area inward of the toner regulating edge 30 to contact the developer roller 50. In this embodiment, the toner regulating edge 30 extends beyond and does not make contact with the developer roller 50. The length of the contact zone 60 between the toner regulating member 10 and developer roller 50 and the position of the contact zone 60 along the member 10 may vary depending upon the application. In one embodiment, the contact zone has a length of about 1 mm. A distance defined as T is measured from the middle of the contact zone to the toner regulating edge 30. In specific embodiments, the distance T is between about 0.6 mm and 1.4 mm.

FIG. 3 illustrates one embodiment of the gap 40 extending into the toner regulating edge 30. The gap 40 of this embodiment comprises an upper edge 45, an inner edge 46 and an outer edge 41. The upper edge 45 is linear and may be substantially parallel to the toner regulating edge 30. The inner and outer edges 46, 41 are substantially linear and may be orientated substantially perpendicular to the toner regulating edge 30. The corners 48 formed between the upper edge 45 and inner and outer edges 46, 41 may be rounded. The depth of the gap 40 is set such that at least a portion of the upper edge 45 is within the contact zone 60.

FIG. 4 illustrates a schematic view of a toner regulating member 10 having a gap 40 adjacent to each lateral edge 32. A print zone 62 is positioned within the interior area of the toner regulating member 10 between the gaps 40. The toner in the print zone 62 is carefully controlled to produce good print quality during image formation. The gaps 40 are positioned outside of the print zones 62 and act to remove excess toner that builds towards the outer edges of the developer roller 50. In the embodiment of FIG. 4, the print zone 62 extends to the edge of the gaps 40. In other embodiments, the print zone 62 may be positioned a distance inward from one or both gaps 40.

The depth of the gaps 40 is selected for at least a portion of the upper edges to be within the contact zone 60. In the left-side gap 40 of FIG. 4, the upper edge 45 is within the contact zone 60 and acts to remove a large amount of toner from the developer roller 50. In the right-side gap 40, the edges 43 extend into the contact zone 60 and remove the toner as there is no separate upper edge in this shape. Removal of excess toner from the edges of the developer roller 50 reduces or eliminates excess toner being transferred to the media sheets along the lateral edges i.e., banding. The width of the gaps 40 is set to remove the banding, but not to interfere with the print zone 62.

Figure 5:
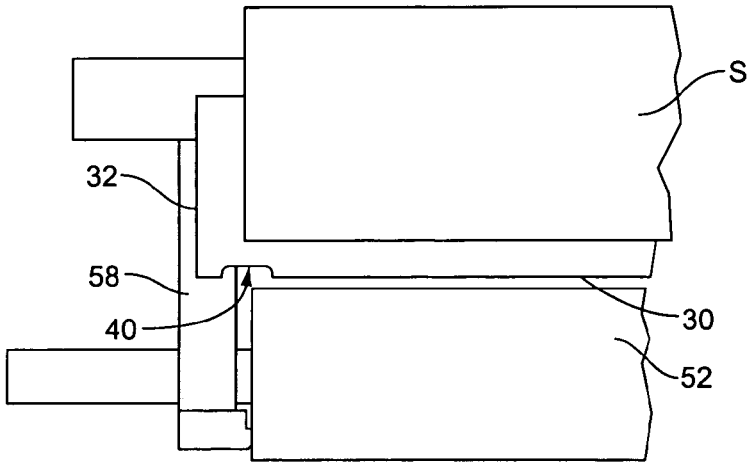
FIG. 5 is a partial side schematic view of the toner regulating member, toner adder roller, and seal member according to one embodiment of the present invention.

The gap 40 extends inward from the lateral edge 32 allowing for placement of a sealing member 58 to prevent toner escape. FIG. 5 illustrates one embodiment of sealing member 58 positioned along the lateral edge of the toner regulating member 10 and into a portion of the gap 40. Toner is maintained within the interior section of the toner regulating member 10 and accurately transferred within the print zone 62. Excess toner that moves laterally along the toner regulating member 10 is removed at the gap 40. Further, the sealing member 58 prevents the toner from laterally escaping. A media sheet S is illustrated in the embodiment of FIG. 5 illustrating a widest media size. A toner band typically forms just outside the end of the toner adder roller 52 and extends slightly past the inner edge of the seal 58. As illustrated in FIG. 5, the edge of the media sheet S is positioned within this banding zone. The position of the gap 40 is chosen to eliminate this band where it corresponds with the edge of the sheet S. In this embodiment, the gap 40 inner edge is located to be inboard of the toner adder roller edge and outside of the print zone. The outer edge of the gap 40 is set to be within the width of the seal 58 and outside the media sheet edge.

Figure 6:
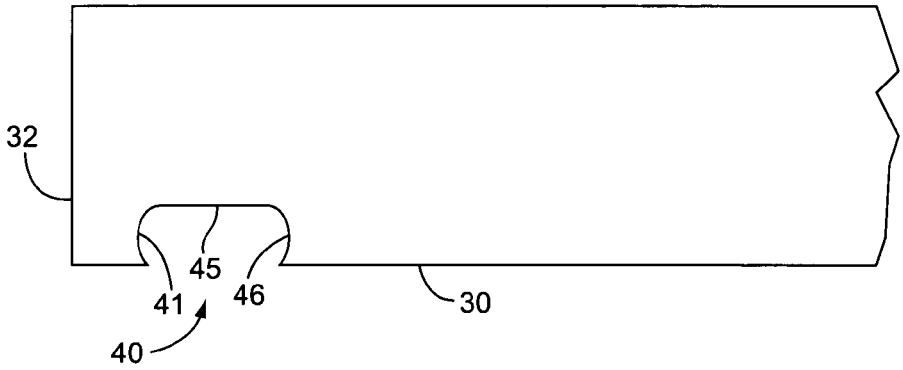
FIG. 6 is a partial side schematic view of a gap in the toner regulating edge according to one embodiment of the present invention.
Figure 7:
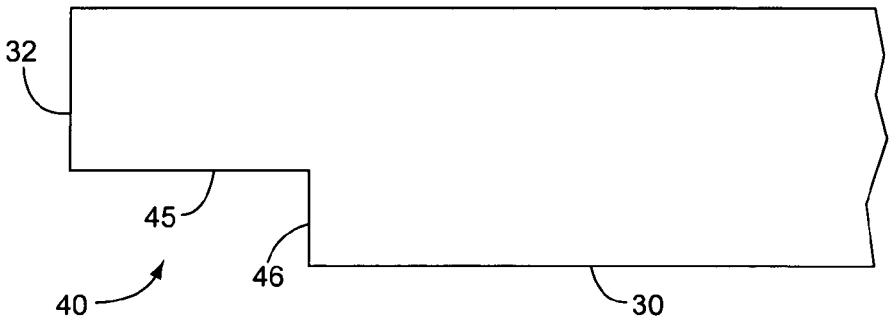
FIG. 7 is a partial side schematic view of a gap in the toner regulating edge according to one embodiment of the present invention.

The shape and size of the gap 40 may vary depending upon the application. The depth is adjusted such that at least a portion of the gap 40 is positioned within the contact zone 60. The width is established to remove an adequate amount of toner and prevent banding. FIG. 7 illustrates another embodiment of a gap 40 having an inner edge 46 and an upper edge 45 that extends out to the lateral edge 32 of the toner regulating member 10. In this embodiment, the upper edge 45 and the toner regulating edge 30 are substantially parallel. Another embodiment features the upper edge 46 extending at an angle relative to the toner regulating edge 30. FIG. 6 shows an alternate embodiment of a gap with an arcuate inner edge 46 and outer edge 41. FIG. 4 illustrates additional gaps 40. The left gap 40 is spaced inward from the lateral edge 32 and includes a first edge 41 substantially perpendicular to the toner regulating edge, and an angled second edge 42. The right gap 40 is spaced inward from the lateral edge 30 and includes two angled edges 43 extending into the contact zone 60. Variations in the shape and size of the gap 40 are within the scope of the invention. In these alternate embodiments, the gap 40 may be arcuate in shape, have a single continuous edge, have two sides coming together at an angle, or have more than three sides. In each embodiment of the invention, the gap 40 sides 45, 46, 41, 42, 43 may be linear or non-linear.

The toner regulating member 10 may be made of or coated with electrically conductive material such as resin, metal, metallic salt or ions. In one embodiment, the toner regulating member 10 is made of phosphor bronze. In one embodiment, the toner regulating member 10 has a thickness of about 0.003 inches. In another embodiment, the toner regulating member 10 is about 0.001 to about 0.01 inches thick. In one embodiment, the toner regulating member 10 is a phosphor bronze coated with a resin that is conductive and has a surface roughness of about 0.2–1.0 microns.

The present invention can be carried out in other specific ways than those herein set forth without departing from the scope and essential characteristics of the invention. In one embodiment, a toner regulating member 10 has a plurality of gaps 40 in the regulating edge 30. In another embodiment, multiple toner regulating members may be mounted sequentially.

What is claimed is:

1. A device to regulate toner on a developer roller within an image forming apparatus comprising:

a longitudinal edge;

a lateral edge that forms a corner with the longitudinal edge;

a regulating section spaced inward from the longitudinal edge and in contact with the developer roller; and a gap positioned within the longitudinal edge and spaced inward from the corner, the gap extending inward from the longitudinal edge into the regulating section.

2. The device of claim 1, wherein the gap includes an inner edge, an outer edge and an upper edge.

3. The device of claim 2, wherein the upper edge is located within the regulating section that contacts a developer roller.

4. The device of claim 3, wherein the upper edge is positioned entirely within the regulating section.

5. The device of claim 2, wherein the upper edge is substantially parallel to the longitudinal edge.

6. The device of claim 2, wherein the inner and outer edges are substantially parallel.

7. A device to contact and regulate toner on a developer roller within an image forming apparatus comprising:

an edge that extends beyond the developer roller;

a regulating section that contacts the developer roller, the regulating section being spaced inward from the edge; and a gap defined between first and second points along the edge and having a depth to extend into the regulating section.

8. The device of claim 7, wherein the gap comprises three separate sides.

9. The device of claim 7, wherein the gap has at least one arcuate edge.

10. The device of claim 7, further comprising a second gap positioned along the edge and being spaced apart from the gap.

11. The device of claim 7, further comprising a mounted edge opposite from the edge, the mounted edge being mounted to the image forming apparatus.

12. The device of claim 7, wherein a distance defined between a center of the regulating section and the edge is between about 0.6 mm and about 1.4 mm.

13. The device of claim 12, wherein the regulating section has a length of about 1 mm.

14. A device to regulate toner on a developer roller within an image forming apparatus comprising:

a longitudinal edge;

a regulating section positioned inward from the longitudinal edge and in contact with the developer roller; and a gap positioned along the longitudinal edge having an upper edge substantially parallel to the longitudinal edge and extending into the regulating section.

15. The device of claim 14, wherein the gap extends inward from a lateral edge.

16. A device to regulate toner within an image forming apparatus comprising:

a developer roller;

a regulating member having a longitudinal edge and a regulating section spaced inward from the longitudinal edge to contact and regulate the toner on the developer roller; and a gap extending inward from the longitudinal edge and having a regulating edge positioned within the regulating section.

17. The device of claim 16, wherein the gap comprises at least two sides.

18. The device of claim 16, wherein the developer roller rotates in a direction into the longitudinal edge of the regulating member.

19. The device of claim 16, wherein the gap has at least one arcuate section.

20. The device of claim 16, further comprising a second gap extending inward from the longitudinal edge and being spaced apart from the gap.

* * * * *